United States Patent [19]

Mueller

[11] Patent Number: 5,036,757

[45] Date of Patent: Aug. 6, 1991

[54] APPARATUS FOR SHELLING AND DE-GERMINATING CORN

[75] Inventor: Roman Mueller, Niederuzwil, Switzerland

[73] Assignee: Buehler AG, Uzwil, Switzerland

[21] Appl. No.: 348,485

[22] PCT Filed: Jul. 18, 1988

[86] PCT No.: PCT/CH88/00126

§ 371 Date: Mar. 20, 1989

§ 102(e) Date: Mar. 20, 1989

[87] PCT Pub. No.: WO89/00454

PCT Pub. Date: Jan. 26, 1989

[30] Foreign Application Priority Data

Jul. 22, 1987 [CH] Switzerland ..... 2783/87

[51] Int. Cl.[5] ..... B02B 3/00; B02B 3/08

[52] U.S. Cl. ..... 99/519; 99/523; 99/607; 99/608; 99/618; 241/285 A

[58] Field of Search ..... 99/602–607, 99/610–615, 617, 618, 518, 519, 523–528, 608, 622, 628; 426/481–483; 241/86.1, 88.2, 93, 285 A, 286, 285 B; 51/4, 22

[56] References Cited

U.S. PATENT DOCUMENTS

| | | | |
|---|---|---|---|
| 862,975 | 8/1907 | Kerr et al. | 99/607 |
| 912,449 | 2/1909 | Dieterich | 99/606 |
| 1,099,317 | 6/1914 | Shultz | 99/606 |
| 1,100,190 | 6/1914 | Lund et al. | 99/606 |
| 2,618,307 | 11/1952 | Keller | 99/606 |
| 3,734,752 | 5/1973 | Headley . | |
| 4,229,486 | 10/1980 | Muller | 99/519 |
| 4,292,890 | 10/1981 | Salete-Garces | 99/617 |
| 4,515,075 | 5/1985 | Satake | 99/519 |
| 4,583,455 | 4/1986 | Salete-Garces | 99/603 |

FOREIGN PATENT DOCUMENTS

| | | | |
|---|---|---|---|
| 8605716 | 10/1986 | PCT Int'l Appl. | 99/608 |

*Primary Examiner*—Timothy F. Simone

*Attorney, Agent, or Firm*—McAulay Fisher Nissen Goldberg & Kiel

[57] ABSTRACT

The apparatus comprises a stator (1) and a rotor (3) rotatably supported in a stator housing (2) with a processing space (9) therebetween. The stator housing (2) and rotor (3) are fitted with knobs on their mutually facing sides in the region of the processing space (9) where the corn is processed. Work elements (8, 13, 21) with knobs are positioned in approximation of a circle at the stator housing (2) and at the rotor (3). The inside of the stator housing is divided in the cirucmferential direction into siftings segments (21, 22) with sieve holes provided in an alternating manner with knob segments. The stator housing (2) includes at least two detachable housing wall parts (14, 15) making the processing space (9) easily accessible in the event of operational disturbance therein.

20 Claims, 7 Drawing Sheets

APPARATUS FOR SHELLING AND DE-GERMINATING CORN

BACKGROUND OF THE INVENTION

The present invention is directed to an apparatus for shelling and degerminating corn.

At the present time, corn is processed in large quantities to form the greatest variety of end products. In addition to the wet de-germinating of the corn for starch production, the corn is de-germinated and ground for conventional uses in milling. The end products of the processing in the mill are substantially supplied to the feedstuff and oil industries, the brewing industry, polenta production, the snack product industry or corn flake production. Each of these uses places different demands on the processing in the mill, wherein the investment and processing costs for the processing in the mill increase in the sequence of intended uses named above.

The apparatus, according to the invention, is used for the production of flaking grits which constitute the starting product for corn flake production. The demands placed upon milling are the highest in this instance. The de-germinating and shelling of corn for this purpose have been effected for decades in the "Beall de-germinator". The latter comprises a stator, a rotor being rotatably supported in the stator housing. The stator housing and the rotor form a processing space which is at least approximately annular in cross section and have knobs on their mutually facing sides. In addition, the inside of the stator is divided into siftings segments in the circumferential direction, which siftings segments are provided alternately with knobs or with a sieve hole, respectively. This known apparatus also comprises a stator housing having two parts, whose two halves are separated by a horizontal plane and are swivelable relative to one another around a hinge axis and can be screwed together in the closed state. If the upper half of the stator housing is removed (folded up), the lower half forms a trough, which is shaped like a half-circle in cross section, the rotor which is held in bearing half-shells at the ends lies in the trough. By means of folding up the upper stator housing half, the lower half of the processing space is not accessible. The rotor must also be removed for this purpose. In addition, the Beall de-germinator comprises a conical work space which increases in diameter from the inlet end to the discharge end, and the stator housing and rotor are constructed conically in a corresponding manner. If the work space is to be changed in the direction of the rotor radius corresponding to the nature of the corn to be processed, the rotor is axially displaced in the stator housing. This requires a comparatively costly bearing support. If it is necessary to build such machines for greater outputs with longer processing spaces, the diameter of the rotor and stator housing must be correspondingly enlarged toward the discharge end, as well. Another disadvantage of this apparatus is the fact that the corn dust portion in the flaking grits is high, which detracts from the yield.

SUMMARY OF THE INVENTION

The object of the present invention is to improve an apparatus of the type described above in such a way that the processing space is easily accessible in the event of disturbance and the shelling and de-germinating process can be managed in an optimal manner.

Blockage in the processing space can be corrected by means of the detachable housing wall parts when the machine is running. In particular, the cross section of the processing space can be adapted to the nature of the material to be processed without an axial displacement of the rotor.

When the processing space, which is annular in cross section, has the same or at least approximately the same diameter along its entire length, its length can be increased without the machine taking up more space in width or height. In addition, the occurrence of dust in the discharge is greatly reduced by means of this step and the required power is lower while maintaining the same product throughput. The advantage of the lower portion of dust in the discharge is that the latter need not be fed to the additional sifters jointly with the siftings, as was previously the case. The cost for the subsequent sifting is accordingly reduced. A further advantage results in that the output can be doubled with half the power requirement while maintaining the same rotor length as in the Beall de-germinator and with the same work quality.

In the apparatus, according to the invention, the processing space can be opened in the event of disturbance in an effortless manner along a circumferential angle of approximately 270° and the disturbance can be eliminated.

It is possible to adjust different radial spacing of the adjustable knob segments in the end areas of the processing space and accordingly to adjust the manner of operation of the apparatus in an optimal fashion.

The knob segments, which are exposed to considerable wear, can be exchanged on the side of the stator as well as on the side of the rotor without needing to exchange the rotor. The down times of the machine and the maintenance costs are accordingly greatly reduced.

BRIEF DESCRIPTION OF THE DRAWINGS

The invention is explained by way of example by means of the attached schematic drawing.

DESCRIPTION OF THE PREFERRED EMBODIMENTS

Figure 2:
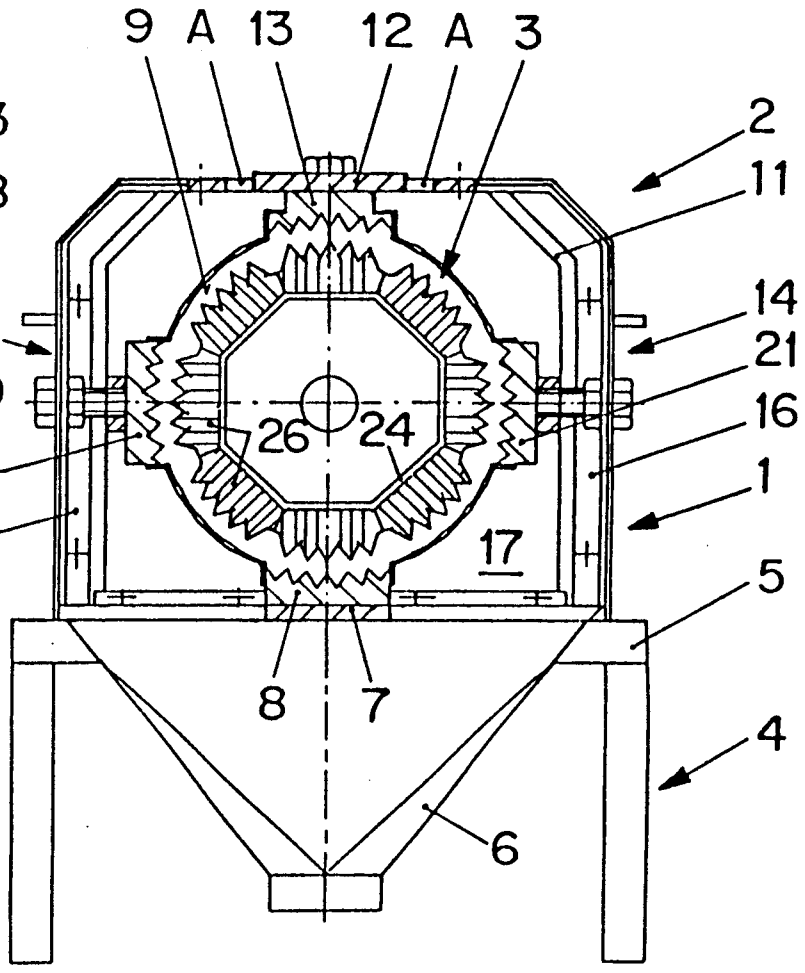
FIG. 2 shows a section along line II—II in FIG. 1.
Figure 1:
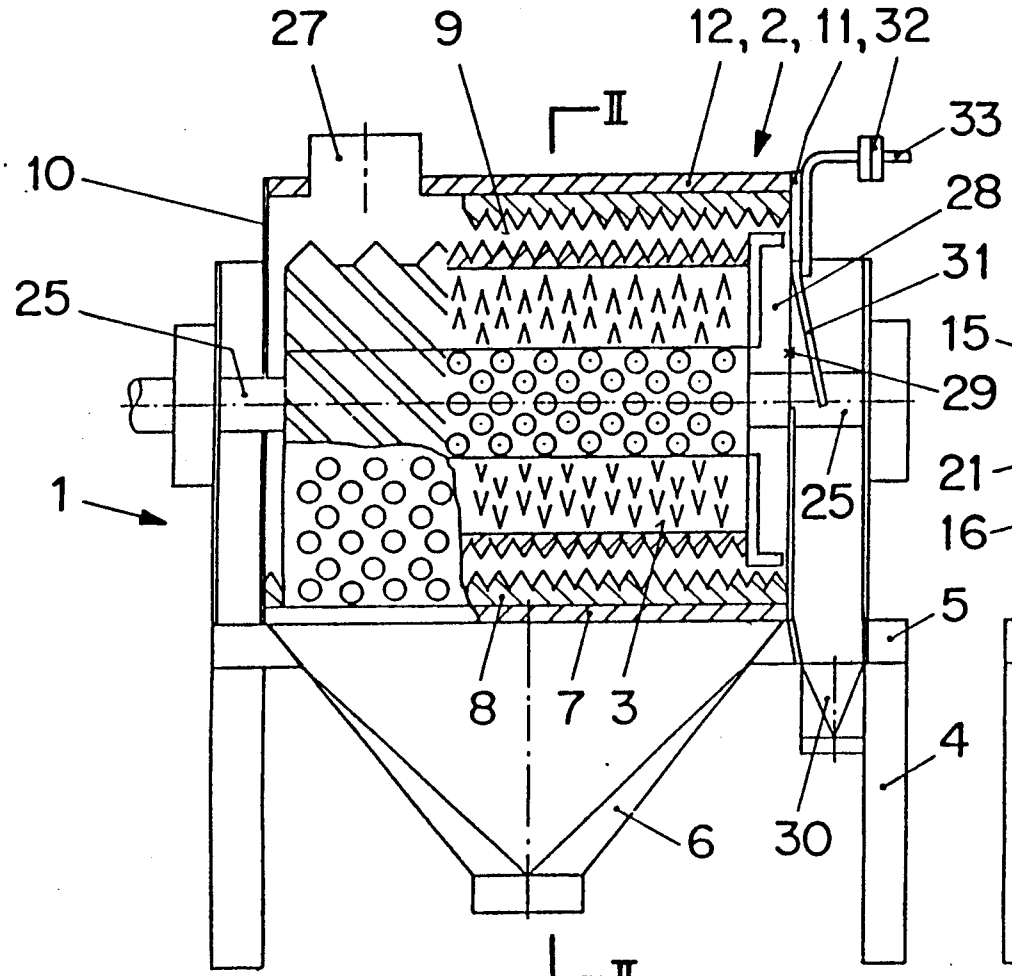
FIG. 1 shows a side view of an apparatus, wherein parts of the stator housing are omitted.

The stator 1 of the apparatus shown in FIGS. 1 and 2 comprises a stator housing 2 which encloses a rotor 3, the rotor 3 being supported therein so as to be rotatable, and is mounted on the horizontal supporting frame 5 of a stand 4 and opens at the bottom into an adjoining funnel 6. The siftings are guided through the latter. A longitudinal support 7 bridges the frame 5 in the longitudinal direction, a knob segment 8 comprising knobs (spikes) directed against the processing space 9 being fastened thereon. The stator housing 2 is closed at the ends by means of a front plate 10 and plate 11 whose upper sides are connected and strengthened by means of a longitudinal support 12. The latter supports an additional knob segment 13 whose knobs, which are directed into the processing space 9, lie diametrically opposite those of the knob segment 8. In addition, the support 12 is provided with two adjustable aspirating slots A so that the space for the siftings can be sufficiently ventilated. The screw connection between the longitudinal support 12 and the knob segment 13 can be effected by means of adjusting screws with which the radial distance of the knob segment 13 from the rotor 3 can be adjusted.

Further, there are two detachable housing wall parts 14 and 15 of the stator housing 2 between the two front plates 10 and 11 and at opposite sides of the longitudinal supports 7 and 12. Angle sections 16, which are screwed to the front plates 10 and 11, respectively, are located at the ends of these housing wall parts 14 and 15. The housing wall parts 14 and 15 adjoin the two front plates 10 and 11 with end plates 17 which are securely connected with one another by means of two angle section strips 18 and 19 and a U-section support 20. Another knob segment 21 is screwed into each U-section support 20. In addition, a siftings segment 22 in the form of a perforated plate is fastened between the U-section support 20 on one side and the angle section strips on the other side. The angle section strips 18, 19, the U-section support 20 comprising the knob segment 21, and the end plates 17 form a constructional unit. The latter, together with the angle sections 16, form a housing wall part 14 or 15 with which they are connected at the ends by means of an adjusting screw 23 in each instance. When the adjusting screw 23 is turned, for which purpose the manual expenditure of force is slight, the entire constructional unit is displaced toward the longitudinal central axis of the processing space or away from the latter. If the screw connection between the angle section strips 16 and the contacting front plates 10, 11 is loosened, the two housing wall parts 14, 15, i.e. the constructional unit 17 to 21, including the angle section strips 16, can be removed to the side, and the processing space 9 with the rotor 3 can be opened to a great extent.

A hollow section with axle stubs 25 at the ends, which hollow section is octagonal in cross section, forms the core 24 of the rotor 3. It is supported along with the latter in pivot bearings of the stator housing 2 so as to be drivable. Knob plates 26, which are like circle segments in cross section, are screwed on along the length of the core 24 on its plane portions so as to be detachable. These knob plates 26 are outfitted with knobs in a spiked manner, wherein the knobs are arranged or structured in the shape of a helix in the inlet area (FIG. 1, at left).

Figure 3:
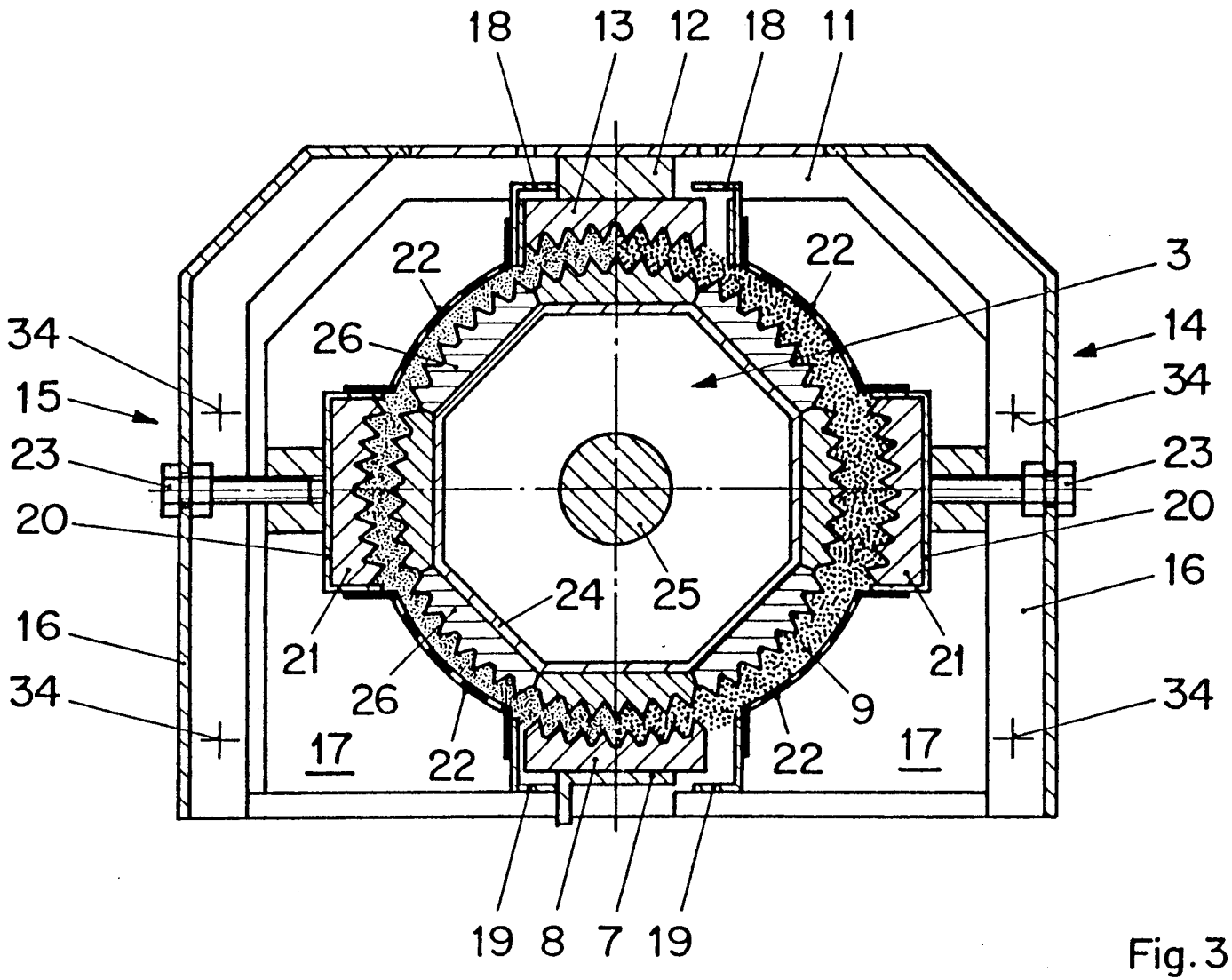
FIGS. 3 and 4 show a section from FIG. 2.
Figure 4:
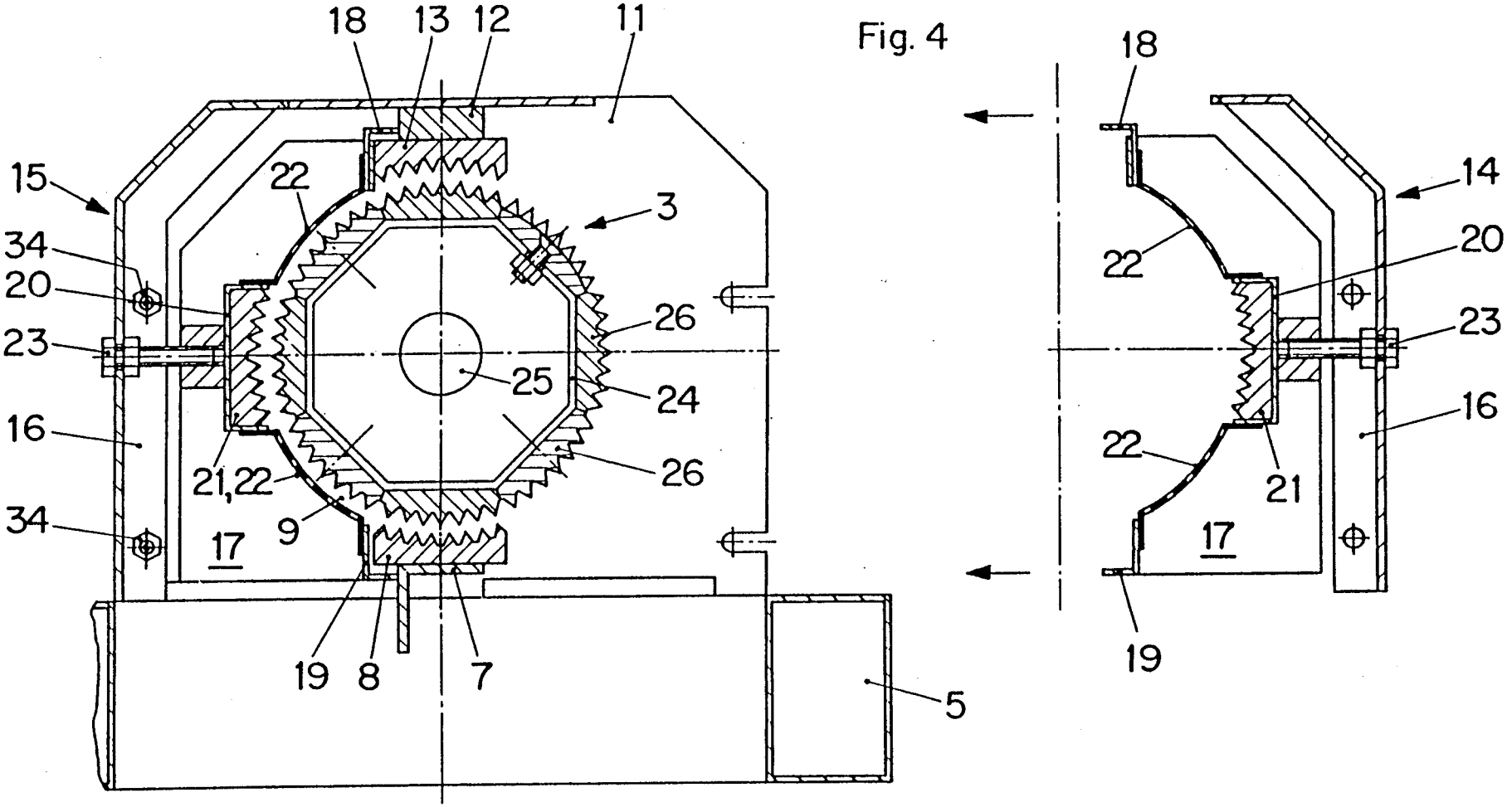

The enveloping surface of the rotor 3 is a cylinder jacket. The processing space 9 has an approximately annular cylindrical shape in cross section in a corresponding manner. The relative speed between the knobs on the stator side and on the rotor side is therefore uniform along the entire length of the processing space. However, the enveloping surface can also be slightly conical without the advantages of the invention as a whole being jeopardized. As shown in FIG. 3, the width of the processing space 9 can be changed by means of turning the adjusting screws 23 in the radial direction in that the oppositely located knob plates 21 of the two housing wall parts 14, 15 with the adjoining siftings segments 22 are displaced toward the rotor 3 or away from it, respectively. According to the intended use, the width of the processing space 9 in the inlet area can be set so as to be larger or smaller than in the discharge area by means of adjusting the adjusting screws 23. The shape of the processing space 9 is therefore adaptable in an optimal manner to the quality of the type of corn to be processed.

The corn to be processed is poured into the processing space 9 through an inlet connection piece 27 in the stator housing 2. The corn is drawn into the processing space by means of the helically structured surface of the rotor in the inlet area, crushed between the knobs and pressed against the farther end, where the endosperm portions making up the tailings arrive in a chamber 28 between the rotor 3 and the front plate !1. The front plate 11 is penetrated by an outlet opening 29 through which the tailings fall into a discharge funnel 30 and which opening can be closed by means of a flap 31. The closing force of the latter is adjustable by means of an adjusting weight 32 which can be displaced on a balance arm 33 which is securely connected with the flap 31. The throughput time of the endosperm portions through the processing space 9 is influenced by the position of the adjusting weight 32.

During the crushing of the corn in the processing space 9, shells, sprouts and endosperm portions are separated and the detached shells, sprouts and a small portion of the endosperm parts fall through the siftings segment 22 into the funnel 6. The larger endosperm portions migrate through the processing zone 9 and pass through the outlet opening 29 into the discharge funnel 30 as tailings.

Should blockage occur in the processing space 9 in the operating state of the machine, it can be eliminated in that the knob segment 21 with the adjoining siftings segments 22 is moved radially outward on one side by means of turning the adjusting screws 23 until the blockage is loosened. The knob segment is then brought back into its working position.

Because of the friction process taking place in the processing space, both the knob plates 26 and the knob segments 8, 13 and 21 are exposed to considerable wear. If the knob plates 26 at the rotor 3 are to be replaced, it is only necessary to remove one of the two housing wall parts 14 or 15 completely after loosening the screw connections 34. One knob plate 26 after the other can then be detached at the rotor and replaced. If the four knob segments 8, 13 and 21 are to be replaced, both wall parts 14 and 15 are removed in the described manner after loosening the screw connections 34 and the worn knob segments are exchanged.

Figure 5:
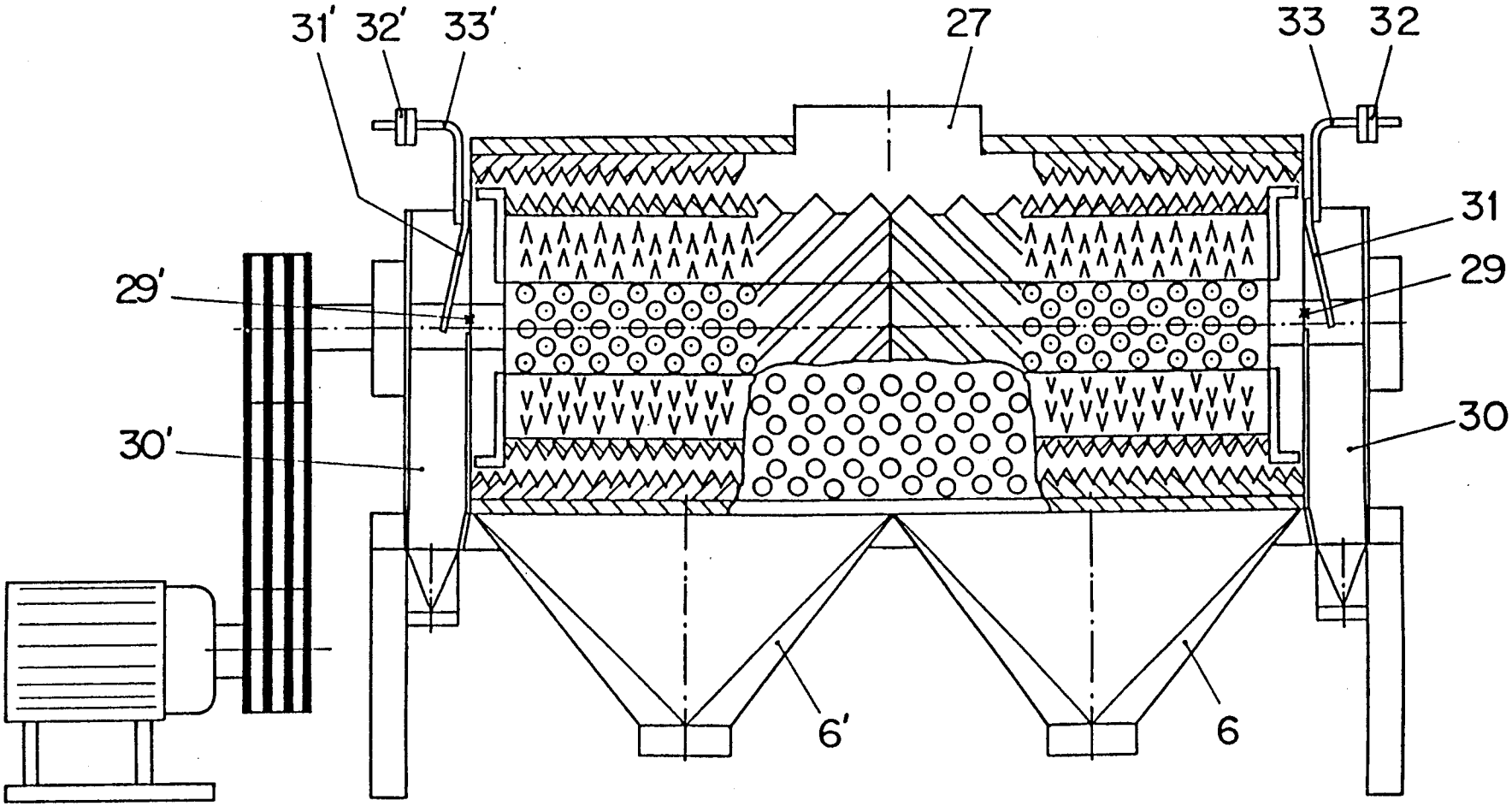
FIG. 5 shows a side view of a second embodiment example of an apparatus in accordance with the invention.

The output is doubled accompanied by the lowest constructional cost and space requirement in the embodiment form according to FIG. 5. In this case, both the stator and the rotor are symmetrical with respect to a vertical plane of symmetry in which the inlet connection piece 27 is centrally located, the plane of symmetry being at a right angle to the rotor axis. The product intake is effected by means of a helical structure at the rotor 3 in the inlet area, which helical structure results from the symmetry and the product is directed in the opposite directions. The discharge of the larger endosperm portions is likewise effected at the two ends of the rotor housing in corresponding discharge funnels 30 and 30'.

The corn material fed through the inlet connection piece 27 is divided up in the processing space and diverted into two opposite directions. In both directions, the corn is subjected to the safe treatment and the siftings are caught correspondingly in two separate funnels 6, 6' and guided together again for further processing. The tailings discharged from the funnels 30 and 30', i.e. the larger endosperm portions, are also combined for further processing.

Figure 6:
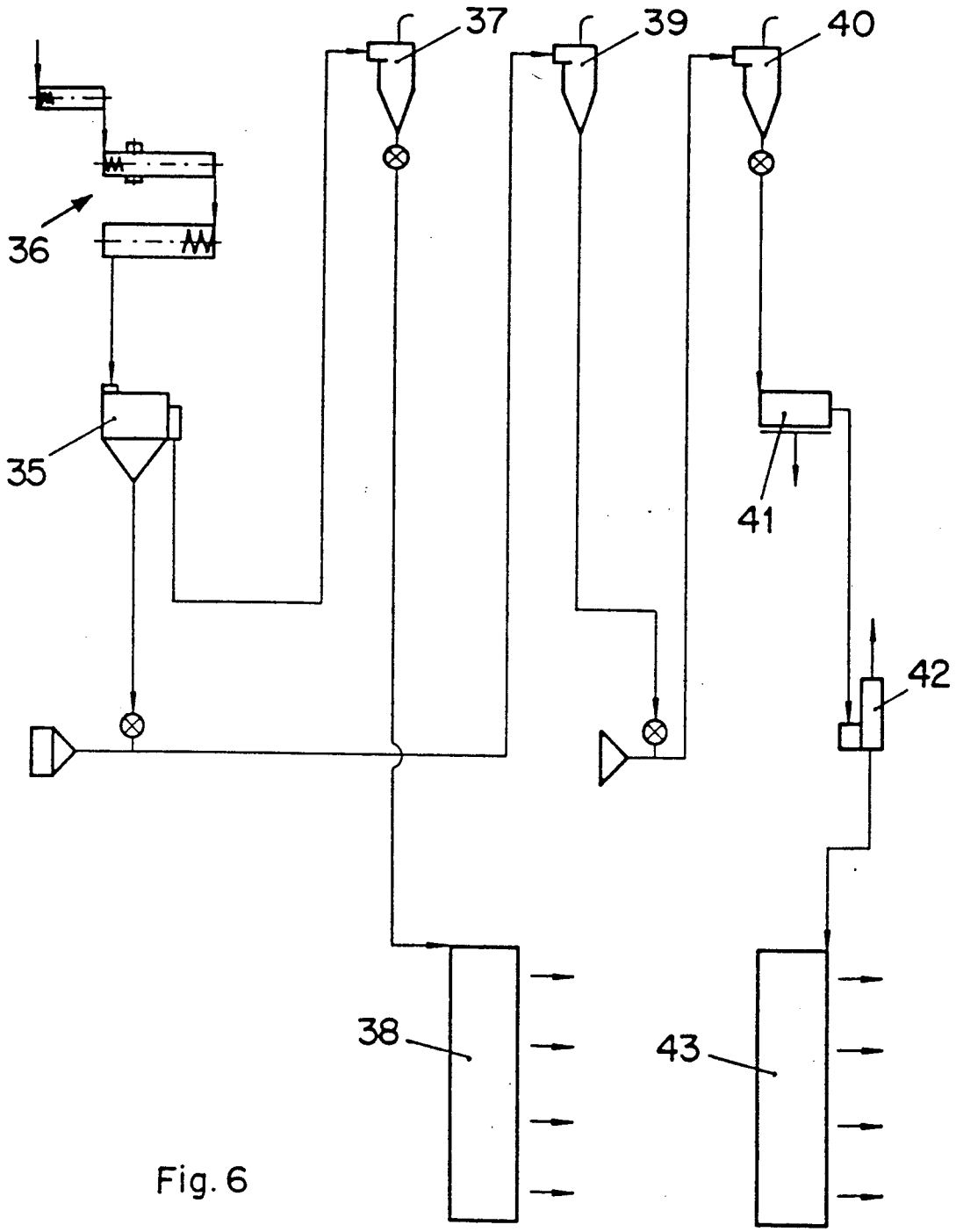
FIG. 6 shows a diagram of a corn processing system.

FIG. 6 shows a production system for flaking grits in which an apparatus 35, according to the invention, is integrated for shelling and de-germinating the corn. After the special units 36 for preparing the corn by means of water and/or steam, the corn arrives in the apparatus 35, according to the invention. Because the tailings are free of meal and shells, they can be fed directly to a plansifter 38 via a cyclone 37. It is not necessary to combine the tailings with the siftings, as is required when using the known devices (because of the meal and shell portion of up to 7% in the tailings). The siftings arrive in a turbine sifter 41 via additional cyclones 39 and 40, which turbine sifter 41 separates out the endosperm portions contained in the siftings and feeds them to a second plansifter 43 via a scale device 42. The cleaning path for the siftings, which comprises a turbine sifter and is more costly in terms of construction, can be dimensioned so as to be smaller and therefore less expensive, since it is no longer loaded by the tailings as was previously the case.

In the embodiments according to FIGS. 7 to 11, the same reference numbers designate the same parts as in the according to FIGS. 1 to 5. The embodiment according to FIG. 7 differs from the latter in that the radial distance between the siftings segments 22 on the one side and the rotor 3 on the other side of the processing space 9 is likewise adjustable. For this purpose, the siftings segments 22 are reinforced at the end by means of flange plates 36 which are penetrated by a slotted hole 37. These flange plates 36 lie against the end plates 17. In addition, the area of the siftings segment 22 adjoining the section strip 18 is bent back in an outward direction so that it forms an abutment surface 38 against the latter. The flange plate 36 can be screwed securely to the end plate by means of a screw 39 which is guided through the slotted hole 37, and in addition it overlaps the other end area of the siftings segment 22 with a bent portion 40, which end area is bent outward. This bent portion 40 and the siftings segment 22 are provided with a slotted hole 41 through which a threaded shaft 42 engages which fits securely in the leg of the U-section support 20. The flange plate 36 is securely connected with the U-section support 20 by means of tightening a nut 43 on the threaded shaft 42. In order to adjust the radial distance of the siftings segment 22 from the rotor 3 it is necessary only to loosen the screws 39 and the nuts 40 and to displace the siftings segment.

Figure 8:
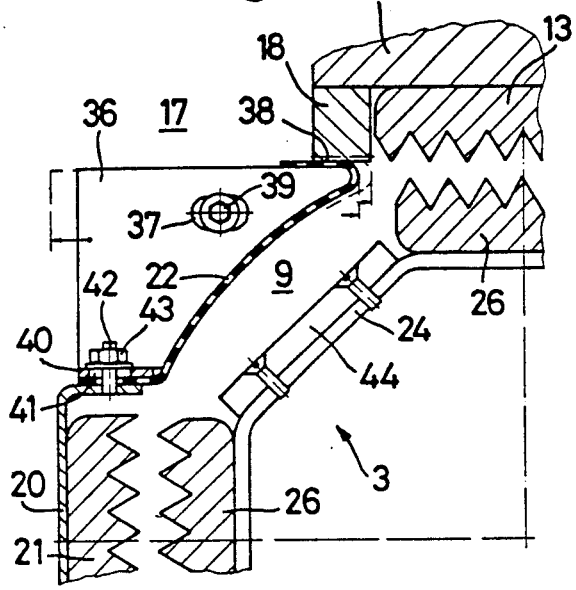
FIGS. 7 to 11 show views, corresponding to FIG. 3, of additional embodiments in accordance with the invention.
Figure 7:
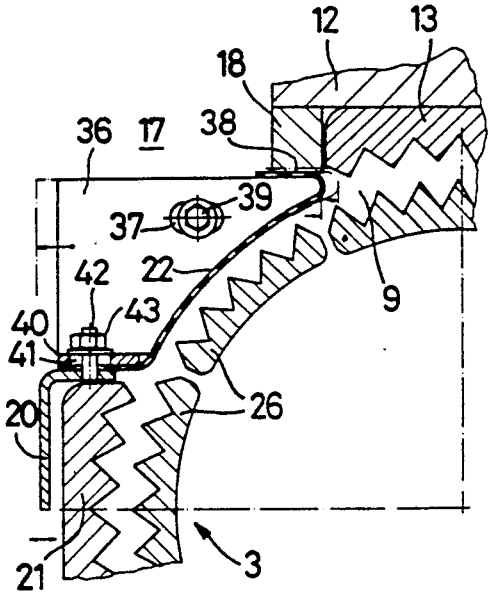

In the embodiment of FIG. 8, the stator housing 2 is constructed in the same manner as in FIG. 7. The design of the core 3 is different. A knob plate 26 is attached only on every second plane portion of the core 24 which is octagonal in cross section, rather than on every plane portion. The portions lying between the latter are equipped with a plane blank plate 24. The embodiment of FIG. 9 differs from that according to FIG. 7 in that the siftings segments 22 are not bent parallel to the enveloping jacket of the rotor 3, but, rather, are planar.

Figure 10:
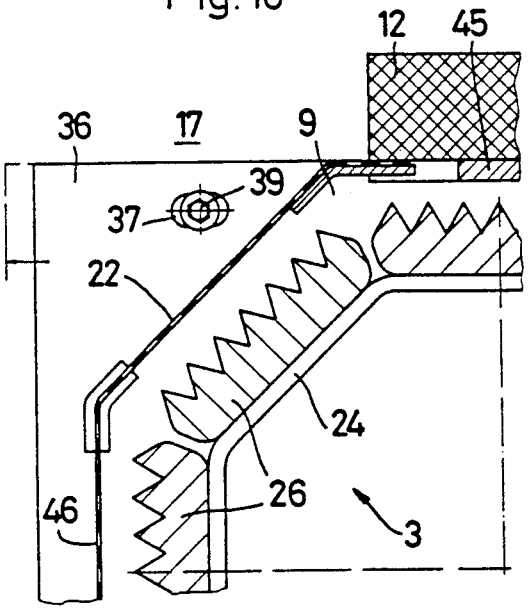
Figure 9:
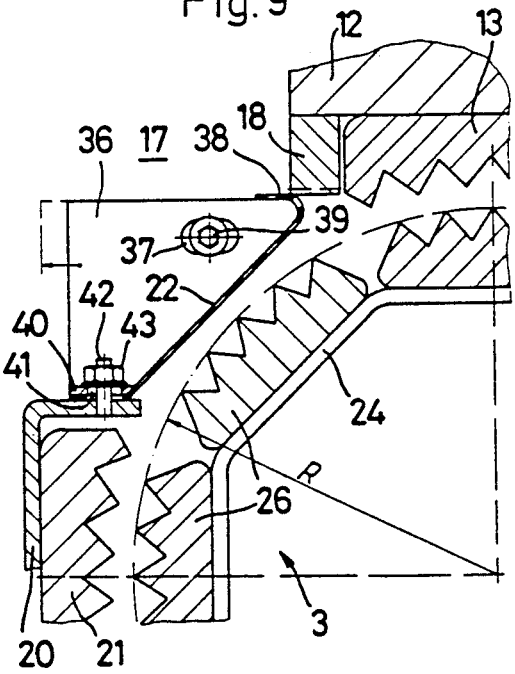

In the embodiment of FIG. 10, the knob segments are absent on the side of the stator (in contrast to the preceding examples). The knob segments 8 and 13 are replaced with blank plates 45 and the knob segments 21 are replaced by siftings segments 46. In addition, the processing space 9 has an octagonal annular cross section.

Figure 11:
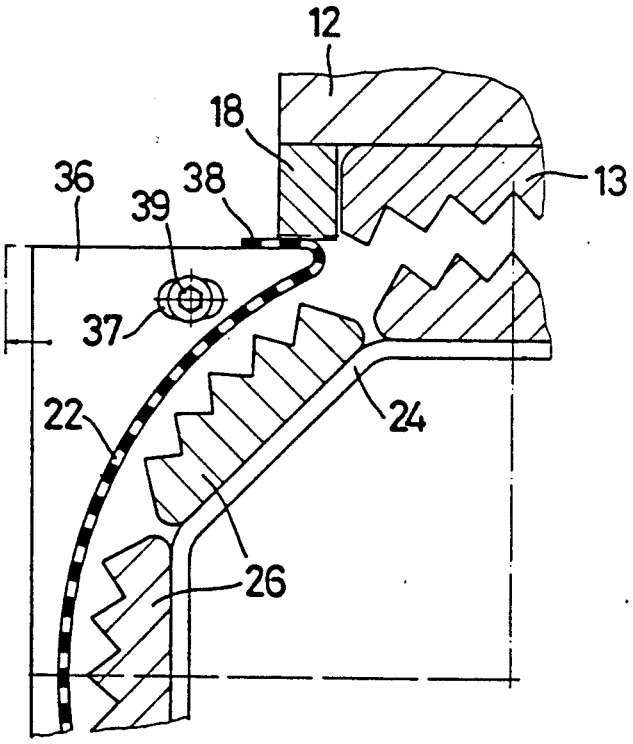

In the embodiment of FIG. 11, the knob segments 8 and 13 of the stator housing are present, whereas; the knob segments 21 are replaced by the siftings segments 22.

I claim:

1. An apparatus for de-germinating corn comprising:

a stator housing including a fixed wall part and at least two detachable wall parts;

a rotor positioned in said stator housing rotatably supported in said stator housing for rotation about an axis, a processing space existing between said stator housing and said rotor and said rotor including knobs facing said processing space;

said stator housing including sifting segments partially defining said processing space, said two detachable wall parts each having at least one knob and both being radially adjustable with respect to the axis of rotation of said rotor.

2. Apparatus as claimed in claim 1, wherein said rotor has a generally uniform diameter.

3. Apparatus as claimed in claim 1, wherein said stator housing further includes knob segments including knobs positioned between said sifting segments in an alternating manner, said knob segments of said stator housing and said sifting segments facing said processing space, and means for supporting and adjusting at least one of said knob segments at said stator housing, said at least one knob segment being radially adjustable relative to the axis of rotation of said rotor.

4. An apparatus as claimed in claim 1, wherein said two detachable wall parts are symmetrical with respect to an imaginary plane containing said axis of rotation of said rotor.

5. An apparatus as claimed in claim 1, further comprising an adjusting means for adjusting said detachable wall parts having said at least one knob segment, said adjusting means being positioned at the outside of said stator housing.

6. An apparatus as claimed in claim 5, wherein said adjusting means is arranged in the end regions of said processing space.

7. An apparatus as claimed in claim 4, wherein said plane is oriented at right angles to a horizontal plane.

8. An apparatus as claimed in claim 1, wherein said stator housing is divided into four housing sectors, and two of said housing sectors form said detachable housing wall parts.

9. An apparatus as claimed in claim 8, wherein said housing sectors forming said two detachable housing wall parts include two said sifting segments and a knob segment facing said processing space.

10. An apparatus as claimed in claim 8, further comprising supporting means for holding said stator housing n position during operation of said apparatus and wherein two of said housing sectors lies opposite one another, and further comprising means for securely connecting said two of said housing sectors with said supporting means.

11. An apparatus as claimed in claim 10, wherein said housing sectors which are securely connected with said supporting means include a knob segment facing said processing space in each instance.

12. An apparatus as claimed in claim 11, wherein at least one of said knob segments of one of said housing sectors is axially adjustable relative to the rotational axis of said rotor.

13. An apparatus as claimed in claim 1, wherein said rotor includes a core forming a uniform polygon in cross section and an envelope surface, knob plates with knobs and having the shape of a circle segment in cross section being detachably fastened at said core.

14. An apparatus as claimed in claim 13, wherein said knob plates extend in one piece along the entire length of said processing space.

15. An apparatus as claimed in claim 14, wherein said processing space has an inlet region and a discharge region and said knob plates include one of helically extending knobs and ribs in said inlet region of the processing space.

16. An apparatus as claimed in claim 13, wherein the envelope surface of said rotor is a cylindrical surface.

17. An apparatus as claimed in claim 13, wherein said processing space has an inlet end and a discharge end, the envelope surface of the said rotor is a conical surface which tapers toward one of said inlet end and said discharge end of said processing space.

18. An apparatus as claimed in claim 1, wherein said stator housing comprises a discharge opening at each end of said processing space and an inlet opening therbetween, said rotor and said stator housing being symmetrical to a plane intersecting said rotor axis at a right angle in the region of said inlet opening.

19. An apparatus as claimed in claim 1, wherein the radial distance between said sifting segments and said rotor is adjustable.

20. An apparatus as claimed in claim 1, wherein said detachable housing wall parts are constructed as sifting segments.

* * * * *